US012507761B1

(12) United States Patent
Kishk et al.

(10) Patent No.: US 12,507,761 B1
(45) Date of Patent: Dec. 30, 2025

(54) GOODYEAR WELT FOOTWEAR AND METHODS FOR MAKING THE SAME

(71) Applicant: American Sole, LLC, San Antonio, TX (US)

(72) Inventors: Jack S. Kishk, Brooklyn, NY (US); Goh Yan Shyang, Klang (MY)

(73) Assignee: American Sole, LLC, San Antonio, TX (US)

( * ) Notice: Subject to any disclaimer, the term of this patent is extended or adjusted under 35 U.S.C. 154(b) by 0 days.

(21) Appl. No.: 19/325,018

(22) Filed: Sep. 10, 2025

Related U.S. Application Data

(60) Provisional application No. 63/693,911, filed on Sep. 12, 2024.

(51) Int. Cl.

| | |
|---|---|
| ***A43D 86/00*** | (2006.01) |
| ***A43B 9/00*** | (2006.01) |
| ***A43B 13/12*** | (2006.01) |
| ***A43D 25/06*** | (2006.01) |
| ***A43D 999/00*** | (2006.01) |

(52) U.S. Cl.
CPC ..... *A43B 13/125* (2013.01); *A43B 9/00* (2013.01); *A43D 25/06* (2013.01); *A43D 86/00* (2013.01); *A43D 999/00* (2013.01)

(58) Field of Classification Search
CPC ..... A43D 25/06; A43D 86/00; A43D 999/00; A43B 9/04; A43B 13/125
USPC ..... 12/142 T, 142 D
See application file for complete search history.

(56) References Cited

U.S. PATENT DOCUMENTS

| | | | | |
|---|---|---|---|---|
| 2,826,770 | A * | 3/1958 | Freeman | A43B 15/00 36/11 |
| 3,028,690 | A * | 4/1962 | Bailey | A43B 15/00 36/14 |
| 5,152,081 | A * | 10/1992 | Hallenbeck | A43B 13/20 428/116 |
| 6,684,532 | B2 | 2/2004 | Greene et al. | |
| 6,834,444 | B2 * | 12/2004 | Issler | A43B 9/02 36/12 |
| 7,426,792 | B2 | 9/2008 | Swigart et al. | |
| 8,245,417 | B2 | 8/2012 | Polegato Moretti | |
| 8,336,229 | B2 * | 12/2012 | La Rochelle | A43B 9/06 36/12 |
| 11,109,639 | B2 | 9/2021 | Shanker et al. | |
| 2003/0150131 | A1 * | 8/2003 | McManus | A43B 7/1445 36/28 |
| 2009/0064535 | A1 * | 3/2009 | Spanks | A43B 9/12 12/146 B |

(Continued)

OTHER PUBLICATIONS

Mack, National Commodity Specialist Division, Customs Ruling NY N337572—The classification, country of origin, and marking of footwear parts from China, Feb. 2024, Control No. CLA-2-64:OT:RR:NC:N2:247, (2 pgs). Accessed at: https://www.customsmobile.com/rulings/docview?doc_id=NY%20N337572&highlight=N337572.

(Continued)

*Primary Examiner* — Marie D Bays
(74) *Attorney, Agent, or Firm* — David B. Gornish; Eckert Seamans Cherin & Mellott LLC

(57) ABSTRACT

Disclosed are methods of assembling footwear, including Goodyear welt boots, in a manner that comports with applicable U.S. laws and regulations that would exempt the footwear from ex-U.S. country of origin labeling requirements, when the components are imported into the U.S.

22 Claims, 9 Drawing Sheets

(56) References Cited

U.S. PATENT DOCUMENTS

| | | | | |
|---|---|---|---|---|
| 2009/0193690 | A1* | 8/2009 | Moretti | A43B 7/125 36/30 R |
| 2011/0099852 | A1* | 5/2011 | Yen | A43B 9/06 12/142 T |
| 2012/0151805 | A1* | 6/2012 | Polegato Moretti | A43B 7/125 36/25 R |
| 2019/0216172 | A1* | 7/2019 | De Callatay | A43D 67/00 |
| 2020/0163406 | A1 | 5/2020 | Chen | |
| 2022/0007783 | A1 | 1/2022 | Ardissono | |
| 2022/0125156 | A1* | 4/2022 | Fu | A43B 7/36 |
| 2023/0320457 | A1* | 10/2023 | Hurt | A43B 13/125 36/25 R |

OTHER PUBLICATIONS

Danner, Cascade Crest Women's boot (Sep. 9, 2024) Accessed at: https://web.archive.org/web/20240909014016/https://www.danner.com/featured-salestyles/women-s-cascade-crest-5-grizzly-brown-ursa-blue-gtx.html.

* cited by examiner

GOODYEAR WELT FOOTWEAR AND METHODS FOR MAKING THE SAME

CROSS-REFERENCE TO RELATED APPLICATIONS

This application claims priority to U.S. Provisional Patent Application No. 63/693,911, entitled FOOTWEAR AND METHODS FOR MAKING THE SAME, filed on Sep. 12, 2024, the contents of which are incorporated-by-reference herein in their entirety.

FIELD OF THE INVENTION

The presently disclosed concept relates generally to footwear and methods for making the same. More particularly, the disclosed concept relates to novel construction of welted footwear, methods for making such welted footwear and apparatus for carrying out the methods.

BACKGROUND OF THE INVENTION

A variety of different footwear constructions are used by the footwear industry. Generally, each construction has characteristics that make it particularly well suited for specific applications. For example, some constructions are selected for their durability, others for their flexibility and comfort, while still others are selected for their aesthetic appeal. One particularly popular type of construction is referred to as a welt construction. Welt or "Goodyear welt" constructions are popular because they are both durable and aesthetically desirable. Goodyear welts are also popular because they are repairable. They allow the soles to be replaced when they wear out, significantly extending the life of the shoes. A welt is a strip of leather, rubber, plastic, or other material that runs along the perimeter of the outsole and attaches the upper to the outsole.

In the United States, various laws and regulations govern tariffs and labeling of products that are made from components manufactured abroad. Generally, products made from components manufactured outside the United States must be marked with the country of origin. However, where further processing of such components to form the finished product is done in the United States, it may be said that the components and product have undergone substantial transformation, which may exempt the components and product from the requirements to mark country of origin. For example, in the case of shoes such as Goodyear welts, it has been determined that importation of the upper with a hole measuring at least the size of a nickel cut through the bottom layers renders the upper "unformed" according to applicable regulations. Further processing such as assembling the imported parts, plugging/closing the upper's bottom and attaching an outer sole is considered substantial transformation, which exempts the components and the final shoe from having to be marked with ex-U.S. country of origin.

Goodyear welt footwear, e.g., in the form of a boot, is a robust construction known for its quality. However, it is not technically straightforward to re-process the shoe/boot as set forth above while still maintaining the shoe's/boot's quality and durability. Reprocessing effectively amounts to repair of the unfinished soles, which if done poorly, can result in defective footwear. This problem is heightened by the fact that in virtually any shoe construction, there will be multiple layers to repair. The skilled person seeking to repair these layers must account for the influence between each layer with an eye towards how natural wear and tear will impact the quality and functionality of the footwear. For waterproof Goodyear welt footwear, it is particularly important that the integrity of the various layers (especially the waterproof gasket) and their interaction with each other during normal wear, will not introduce points of weakness that lead to inoperability and/or deconstruction. There is thus a need in the field for methods for reprocessing (assembling) Goodyear welts to comply with applicable laws and regulations that would exempt the shoes from ex-U.S. country of origin labeling requirements while retaining the shoes' quality and durability.

SUMMARY OF THE INVENTION

Accordingly, in an optional aspect of the disclosed technology, a method of assembling Goodyear welt footwear is provided. The method includes providing a subassembly of unfinished Goodyear welt footwear. The subassembly includes: (i) a lasted upper comprising a base and a foot-receiving cavity extending upward from the base; (ii) a midsole filler located beneath the base; and (iii) a midsole located beneath the midsole filler. The lasted upper, midsole filler and midsole together form a layered composite, the layered composite having formed therein a set of concentric holes through the midsole, the midsole filler and the lasted upper. The set of concentric holes includes a through-hole that penetrates completely through the base and a second blind hole provided through the midsole and at least a portion of the midsole filler. The second blind hole is of a wider diameter than the through-hole. The base includes an underside having a peripheral downward-facing surface surrounding the through-hole.

The method includes inserting an insole filling plug into the through-hole so as to completely fill the through-hole and laying a gasket filler over and in contact with the insole filling plug so as to completely cover the insole filling plug. The gasket filler has a periphery that contacts the peripheral downward-facing surface surrounding the through-hole. The method further includes applying heat and pressure onto the gasket filler to heat seal the insole filling plug and gasket filler to the base, thereby sealing the through-hole and coupling the insole filling plug and gasket filler to the base. The method further optionally includes applying adhesive to an underside of the midsole and within the second blind hole. A midsole filler piece is placed within the second blind hole. Next, the midsole is optionally adhered to an outsole, thereby assembling the Goodyear welt footwear.

Optionally, in any embodiment, the set of concentric holes is located in a front half of the layered composite.

Optionally, in any embodiment, the holes of the set of concentric holes are round and share a common central axis.

Optionally, in any embodiment, the layered composite includes at least one additional layer between the lasted upper and the midsole filler and/or between the midsole filler and the midsole.

Optionally, in any embodiment, the layered composite further includes a lasted board between the base and the midsole filler, there being formed through the lasted board a first blind hole having a wider diameter than the through-hole and smaller diameter than the second blind hole, the first blind hole being part of the set of concentric holes.

Optionally, in any embodiment, the method is carried out (at least in part) using an apparatus. The apparatus includes a product placement slate over which the foot receiving cavity is placed with the underside of the midsole facing generally up such that the set of concentric holes lays atop the product placement slate. When the insole filling plug and gasket filler are in place per the method disclosed, a heat press of the apparatus is inserted into the second blind hole to perform a pressing operation against the gasket filler to perform the step of applying heat and pressure onto the gasket filler to heat seal the insole filling plug and gasket filler to the base, thereby sealing the through-hole and coupling the insole filling plug and gasket filler to the base.

Optionally, in any embodiment, the heat and pressure are applied by the heat press for 5-10 seconds or 12-18 seconds at 150-185° C.

Optionally, in any embodiment, the midsole filler is from 5-7 mm thick or from 7-9 mm thick.

Optionally, in any embodiment, the midsole filler is made from cork, rubber or ethylene vinyl acetate (EVA) foam.

Optionally, in any embodiment, the midsole is made from rubber, ethylene vinyl acetate (EVA) foam or polyvinyl chloride (PVC) foam.

Optionally, in any embodiment, the base includes a waterproof gasket layer.

Optionally, in any embodiment, the insole filling plug is made of the same material as the base.

Optionally, in any embodiment, the midsole filler piece is made of the same material as the midsole filler.

Optionally, in any embodiment, the midsole filler piece fills an entire depth of the second blind hole such that a bottom surface of the midsole filler piece is substantially flush with the underside of the midsole.

Optionally, in any embodiment, the diameter of the second blind hole is slightly wider than the diameter of the midsole filler piece, thereby resulting in a slight annular gap between an outer radial surface of the midsole filler piece and an inner radial surface of the second blind hole.

Optionally, in any embodiment, there is no vertical gap between the insole filling plug and the gasket filler or between the gasket filler and the midsole filler piece.

BRIEF DESCRIPTION OF THE DRAWINGS

The following detailed description of the presently disclosed technology will be better understood when read in conjunction with the appended drawings. In the drawings.

DETAILED DESCRIPTION OF THE INVENTION

While products, methods and apparatus are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Definitions and Introduction to the Technology

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

As used herein, "and/or" means that either or both of the items separated by such terminology are involved. For example, the phrase "A and/or B" would mean A alone, B alone, or both A and B.

As used herein, "generally" means "in a general manner" relevant to the term being modified as would be understood by one of ordinary skill in the art.

Figure 1:
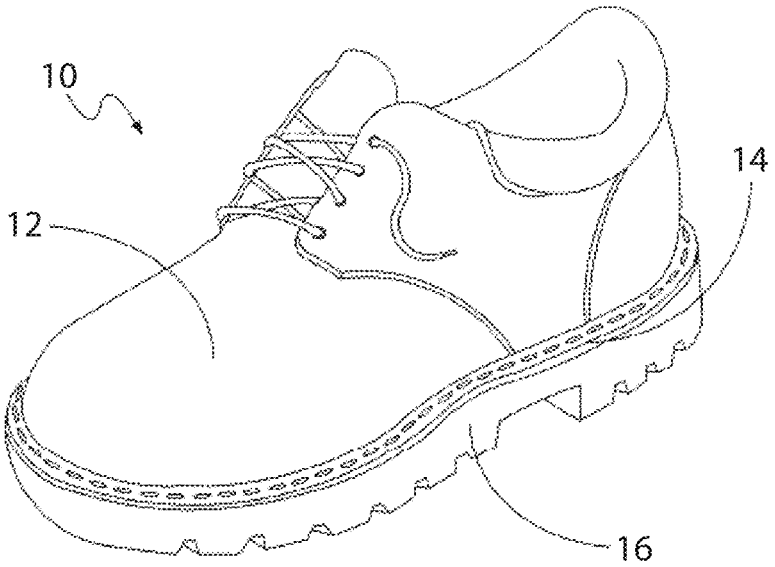
FIG. 1 is a perspective view of footwear employing conventional Goodyear welt construction.
Figure 2:
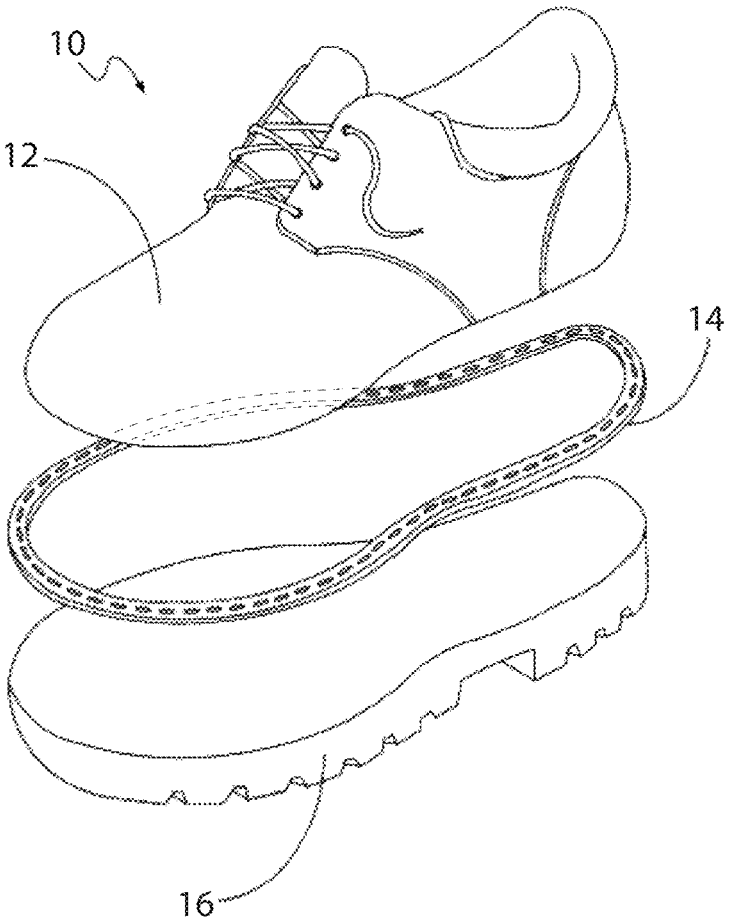
FIG. 2 is an exploded view showing exemplary subcomponents of the footwear of FIG. 1.

Referring now to FIGS. 1 and 2, there is shown an optional piece of footwear 10 that embodies the Goodyear welt construction. The footwear 10 may include a lasted upper 12 (a.k.a. lasted bootie) coupled to an outsole 16 by a welt 14. As shown, the welt 14 is optionally coupled to the lasted upper 12 and to the outsole 16 by stitching. The term "welt" refers to an intermediary structural element defining a point of attachment between the upper 12 and the outsole 16. The welt 14 may be comprised of leather, rubber, plastic, or other suitable material, or a combination of materials.

The term "outsole" refers generally to the structural component that includes the bottom exterior surface of the footwear 10. The outsole 16 generally forms the wearing surface (i.e., ground-contacting surface) of the footwear 10. The outsole 16 may be constructed of a relatively durable, resilient material such as rubber or polyurethane and may have an exterior bottom surface that is provided with a suitable tread to provide ground traction.

The term "lasted upper" or "lasted bootie" refers to a structural element defining an exterior surface and foot-receiving cavity of the shoe. The lasted upper would include an insole and typically a lasted board (a.k.a. strobel board or lasted/strobel board), usually made of paper or fiber, beneath the portion that defines the foot-receiving cavity. In its basic form, the lasted upper comprises a base (comprising an insole and optionally a waterproof gasket) and a foot-receiving cavity extending upward from the base. The lasted board (whether itself part of the insole or a layer below the insole) is configured to attach to other portions of the sole. Depending on the type of shoe (e.g., dress shoe or boot), the foot-receiving portion of the lasted upper can be fashioned of leather, cloth, synthetic materials or a combination. The lasted upper may optionally include more than one layer on the base or within the foot-receiving portion, such as for cushioning and/or waterproofing, for example. In addition, Goodyear welt constructed footwear typically includes a midsole that comprises one or more layers sandwiched between the lasted upper 12 and the outsole 16. The welt 14 forms at least part of the midsole. The preferred type of Goodyear welt footwear according to the disclosed concept is the boot.

As noted above, importation into the United States of a lasted upper with a hole measuring at least the size of a nickel cut through the bottom layers renders the upper "unformed" according to applicable regulations. Further processing that would entail plugging the hole(s) exempts the components and the completed piece of footwear from having to be marked with ex-U.S. country of origin. However, plugging the hole(s) in a manner that ensures quality and durability of the completed piece of footwear is not straightforward. As hole plugging basically requires repair of the shoe, the multiple repaired layers must be made to interact with each other in a manner that would ensure comfort and that will withstand normal wear over the use life. This is true for all unfinished Goodyear welt footwear (e.g., boots) constructed according to the presently disclosed methods, but especially so for the waterproof footwear. The presently disclosed methods help to ensure that the waterproof gasket layer of the insole filling plug is effectively filled and adhered. The inventors discovered that applying the layers from the inside out (i.e., first plugging hole closest to where foot would be, followed by hole(s) closer to the midsole) is important, as is the use of heat and pressure to effectuate sealing of the various holes, to effective repair. The inventors also discovered the importance of having holes of increasing diameter from top to bottom through the layers to ensure robust construction upon filling of the holes.

The presently disclosed technology is directed to methods of finishing and assembling previously unformed Goodyear welt footwear components in a manner that results in a durable and high-quality piece of finished Goodyear welt footwear, e.g., a Goodyear welt boot. The presently disclosed technology also may optionally include an apparatus used to perform aspects of the disclosed methods.

Optional Hole-Filling Machine

Figure 3:
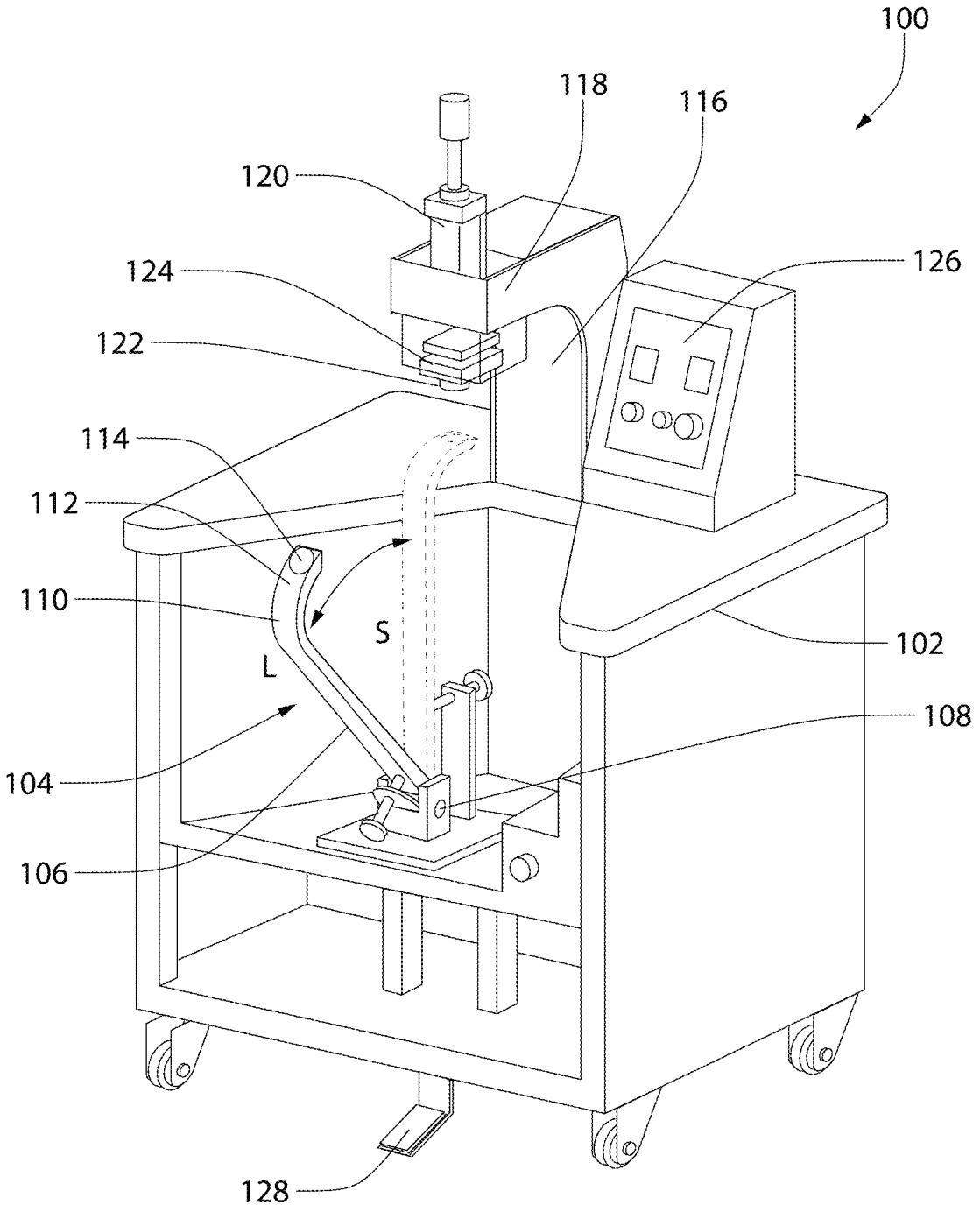
FIG. 3 is a simplified isometric view of a hole filling machine or apparatus according to an optional aspect of the disclosed technology that may be used to carry out certain steps of methods of processing, repairing and assembling Goodyear welt footwear.

Referring now to FIG. 3, there is shown an optional embodiment of a hole-filling machine, referred to alternatively herein as apparatus 100. The apparatus 100 includes a frame 102 comprising a movable (towards and away from frame 102) product placement lever 104. The product placement lever 104 includes an arm 106, which is preferably elongate and substantially straight and is preferably pivotably connected to the frame 102 about a pivot joint 108. Towards the top of the arm 106, the product placement lever 104 includes an elbow 110 that is preferably curved and transitions to a product placement slate 112. The product placement slate 112 protrudes in a direction towards the frame 102 and is perpendicular or substantially perpendicular (±10°) to the arm 106. The product placement slate 112 is of a length that fits within the foot-insertion opening of a lasted upper for a Goodyear welt boot. The frame 102 and the majority of components of the apparatus are made of metal, optionally steel. The product placement slate 112 is likewise predominantly made of metal. However, the upper surface of the product placement slate 112 preferably includes a padded portion 114, which comprises a comparatively softer material, optionally an elastomeric, silicone-based and/or foam material.

The product placement lever 104 is pivotable about the pivot joint 108 away from the frame 102 and towards the frame 102. The product placement lever 104 is shown in solid lines in a first position or product loading position L, in which the product placement lever 104 had been pivoted away from the frame 102 and towards a person (not shown in this figure) operating the apparatus 100. The product placement lever 104 is shown in dotted lines in a second or hole sealing position S, in which the product placement lever 104 has been pivoted towards the frame and away from the person operating the apparatus 100. In the hole scaling position S, the arm 106 is preferably oriented substantially vertical. The direction of movement of the product placement lever 104 is shown by the double-sided arrows between the product loading position L and the hole sealing position S.

The apparatus 100 further comprises a vertical column 116 from which a hood 118 protrudes substantially perpendicular in a direction away from the frame 102, generally towards the product placement lever 104 and the location of the operator of the apparatus 100. A vertically movable cylinder 120 (optionally pneumatically driven) extends perpendicularly from the hood 118 and vertically displaces a heat press 122 upon user-initiated or automated actuation. The heat press 122 may itself have a heating element within it and/or a heating block 124 may reside above and in conductive contact with the heat press 122 in order to apply conductive thermal energy thereto. The heat press 122 is preferably cylindrical with a circular face in order to conform to and fit within the preferably round holes that are to be filled in during a hole filling operation. However, in the event that the holes are alternative shapes (e.g., rectangular, hexagonal or oval), the heat press would be shaped accordingly. The apparatus 100 further optionally includes a monitor 126 to indicate parameters such as time and temperature (for a hole filling/pressing operation). The apparatus 100 also includes various controls to effectuate user-initiated inputs. For example, the apparatus 100 may optionally include a foot controller 128 that effectuates vertical displacement and holding of the vertically movable cylinder 120 and heat press 122. This would allow the user to keep his hands on the footwear subassembly while controlling a pressing and scaling operation with his foot, as will be explained below.

Footwear Subassembly Embodiments Before Hole-Filling

Figure 4:
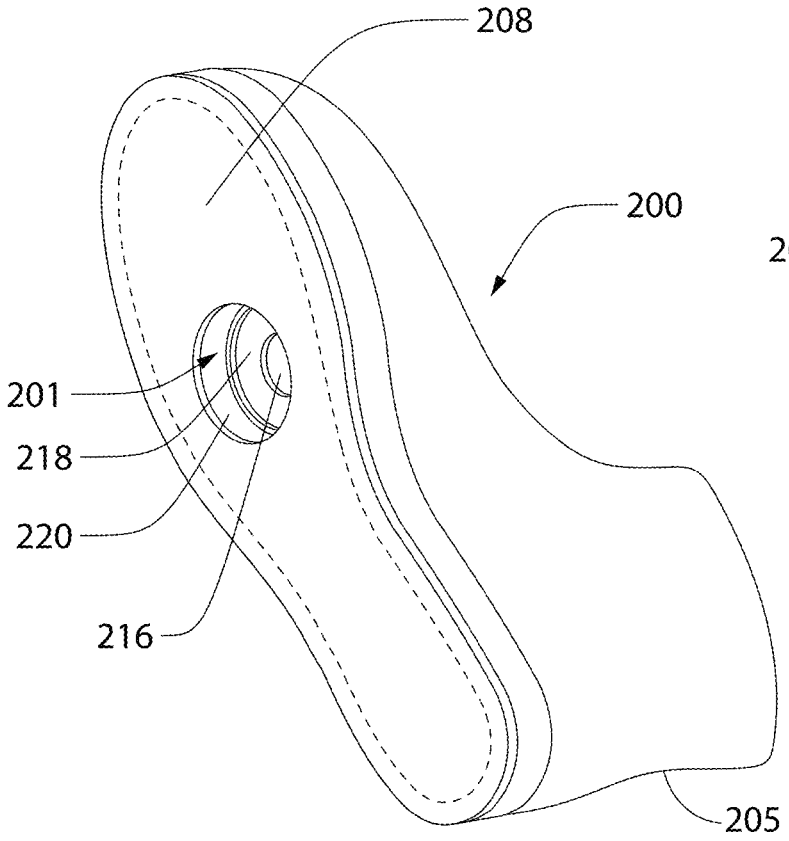
FIG. 4 is a perspective view of a subassembly of waterproof Goodyear welt footwear according to an optional aspect of the disclosed concept.
Figure 5:
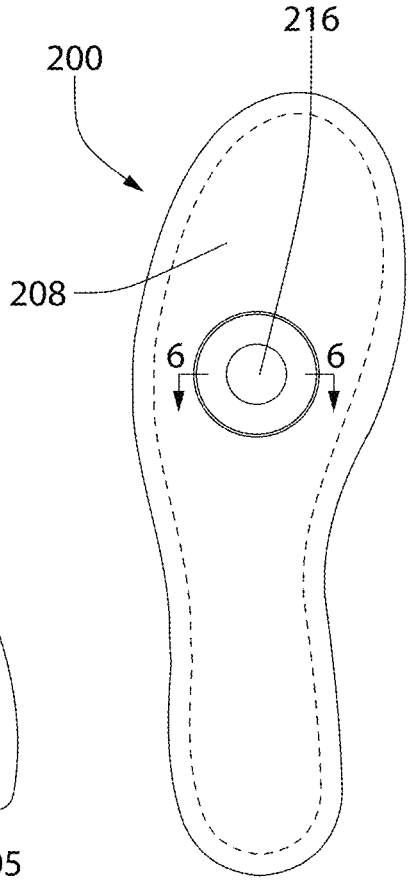
FIG. 5 is a bottom plan view of the subassembly of FIG. 4.
Figure 6:
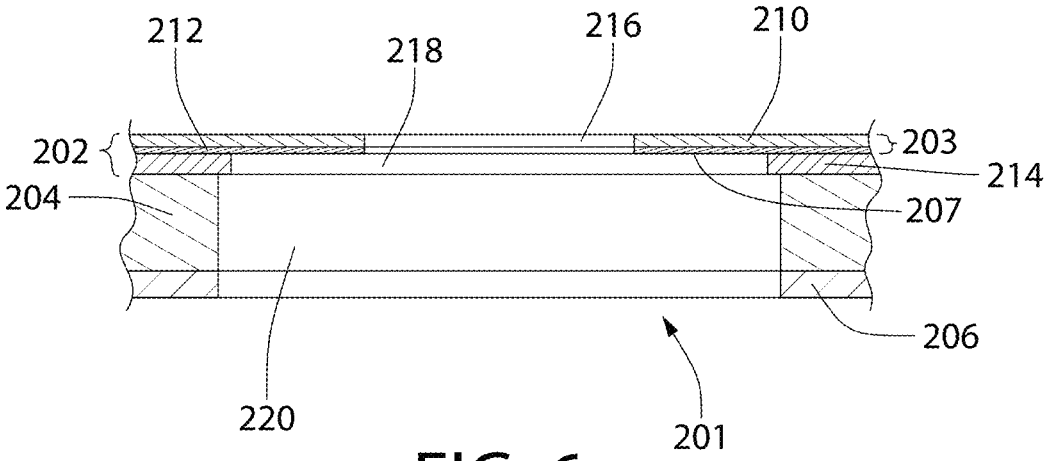
FIG. 6 is an enlarged section view along section line 6-6 of FIG. 5.
Figure 7:
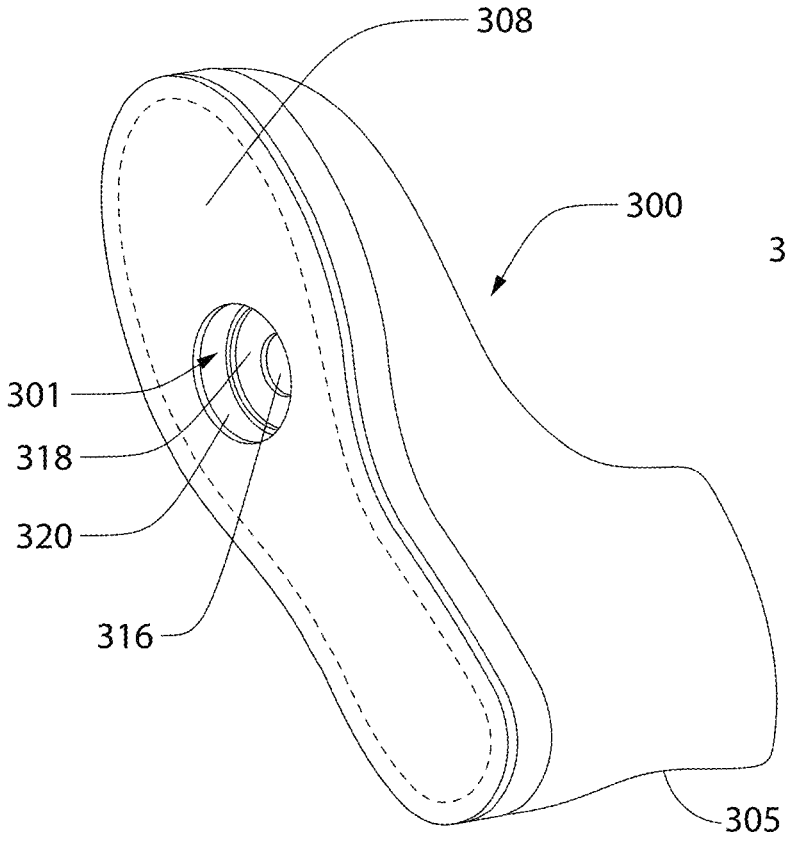
FIG. 7 is a perspective view of an alternative version of a subassembly of Goodyear welt footwear, in a non-waterproof format, according to an optional aspect of the disclosed concept.
Figure 8:
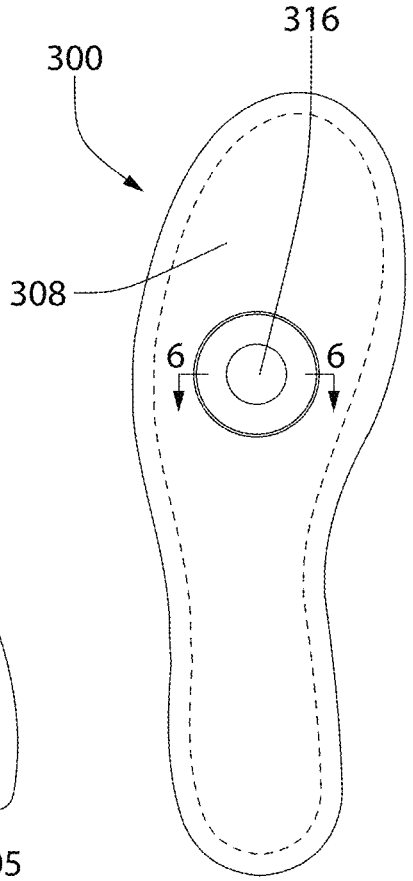
FIG. 8 is a bottom plan view of the subassembly of Goodyear welt footwear of FIG. 7.
Figure 9:
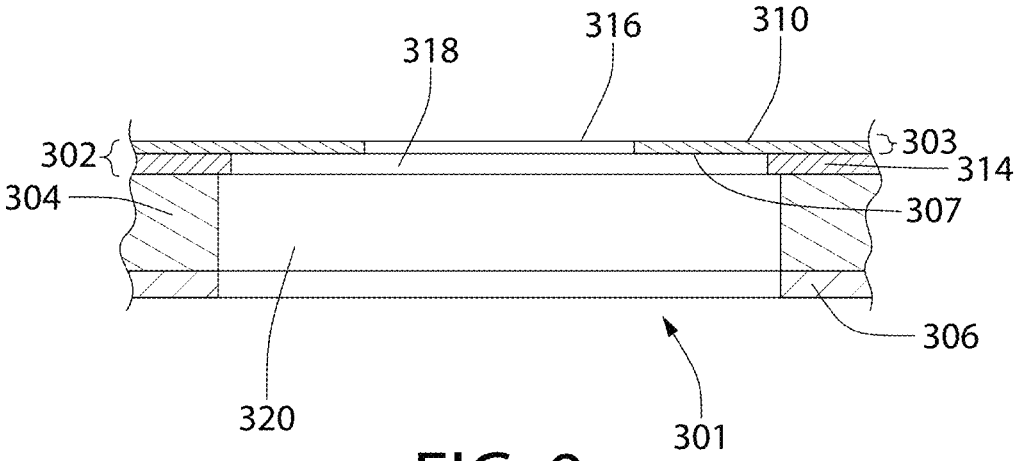
FIG. 9 is an enlarged section view along section line 9-9 of FIG. 8.

Referring now to FIGS. 4-6, there is shown a first embodiment of a subassembly of unfinished Goodyear welt footwear 200 that may be re-processed (i.e., repaired and completed) using methods according to the disclosed technology. FIGS. 7-9 show a second embodiment of a subassembly of unfinished Goodyear welt footwear 300 that may be re-processed (i.e., repaired and completed) using methods according to the disclosed technology. As both embodiments are similar (albeit not identical) in many respects, like elements of each respective embodiment will be described here together, with differences highlighted. The first embodiment is directed to a version of waterproof Goodyear welt footwear while the second embodiment is directed to a version of non-waterproof Goodyear welt footwear.

Each subassembly of unfinished Goodyear welt footwear 200, 300 includes a lasted upper 202, 302 with a midsole filler 204, 304 located beneath the lasted upper 202, 302. A midsole 206, 306 is located beneath the midsole filler 204, 304. These various layers are preferably attached to one another, forming a layered composite. The layered composite may optionally include additional layers/materials between the aforementioned layers/components. Preferably, the lasted upper 202, 302 is attached to the midsole filler 204, 304, which, in turn, is attached to the midsole 206, 306, optionally by stitching, adhesive or both. The skilled person would understand that additional layers or fewer layers may be employed, depending on the specific desired characteristics of the footwear. The midsole 206, 306 includes a bottom surface 208, 308, also referred to herein as an underside. In an optional aspect of the disclosed technology, as discussed further below, adhesive (e.g., liquid glue) may be applied to the bottom surface to attach the midsole 206, 306 to an outsole.

The lasted upper 202 of the subassembly of unfinished Goodyear welt footwear 200 comprises a base 203 and a foot-receiving cavity 205 extending upward from the base 203. The lasted upper 202 preferably includes a composite of the following layers from top (closer to the foot when worn) to bottom (closer to the ground when worn): an insole 210, a waterproof gasket 212 and a lasted board 214. In this embodiment, the insole 210 and waterproof gasket 212 form the base 203.

The lasted upper 302 of the subassembly of unfinished Goodyear welt footwear 300 is very similar to the other version except that the base 303 thereof lacks the waterproof gasket. That is, the lasted upper 302 of the subassembly of unfinished Goodyear welt footwear 300 includes a base 303 and a foot-receiving cavity 305 extending upward therefrom. The lasted upper 302 includes a composite of an insole 310 on top and a lasted board 314 below. In this embodiment, the insole 310 forms the base 303, i.e., they are one in the same.

For both versions, the insole 210, 310 is preferably a fabric material and optionally an additional paper or fiber material and the lasted board 214 is preferably made of a paper or fiber material. When a waterproof gasket 212 is used, it may be made from a membrane (e.g., from rubber or silicone) and optionally a hot melt made from a hydrophobic material.

In any embodiment, the base 203, 303 consists of the layer(s) through which a through-hole completely penetrates (discussed below).

The midsole filler 204, 304 may be made from a durable slightly compressive material, such as ethylene vinyl acetate (EVA) foam, cork or rubber, for example. The midsole 206, 306 may be made from EVA foam, rubber or polyvinyl chloride (PVC) foam, for example. For waterproof versions, the midsole filler 204 may be, e.g., from 7-9 mm thick, optionally about 8 mm thick. For non-waterproof versions, the midsole filler 304 may be, e.g., from 5-7 mm thick, optionally about 6 mm thick.

A set of concentric holes 201, 301 are provided through the various layers of the layered composite of the subassembly of unfinished Goodyear welt footwear 200, 300. These holes are preferably located in the front half of the sole of the respective subassembly of a piece of footwear, i.e., approximately below where the metatarsals would be located when worn. However, the set of concentric holes 201, 301 could be placed at a different location on the sole in other optional aspects of the disclosed concept.

In one aspect, the various layers of the layered composite (lasted upper 202, 302, midsole filler 204, 304 and midsole 206, 306) may be provided separately, attached together, have the holes created and then have the holes filled per the presently disclosed technology. However, it is preferred that the attachment of the various layers and creation of the set of concentric holes 201, 301 are process steps that are done "upstream" before the main steps of reprocessing/repair according to the presently disclosed technology are carried out. In other words, it is contemplated that the unfinished subassembly (with holes and layers attached) would be manufactured abroad and then imported into the United States, where the reprocessing/repair method steps according to the disclosed concept are carried out. It is indeed these holes that render the components of the footwear "unformed" under applicable regulations, as set forth in the Background, above. The set of concentric holes 201, 301 includes preferably round holes, although other shapes (preferably symmetrical) are contemplated, e.g., rectangular, hexagonal, octagonal, triangular or star-shaped, for example. The holes may increase in size by layer from the top (smallest hole) to bottom (largest hole). Optionally, a hole in the midsole is the same size/diameter as a hole in the midsole filler, thereby creating effectively a singular hole, e.g., a second blind hole, as discussed below. The holes preferably are aligned to share the same central axis.

The set of concentric holes 201, 301 includes a through-hole 216, 316, optionally a first blind hole 218, 318 below the through-hole 216, 316 and a second blind hole 220, 320 below the optional first blind hole 218, 318. The through-hole 216, 316 protrudes completely through the base 203, 303 of the lasted upper 202, 302 and thus at least through the insole 210, 310. In the case of the subassembly of unfinished Goodyear welt footwear 200, the through-hole 216 also protrudes through the waterproof gasket 212. In any embodiment, the base 203, 303 comprises an underside having a peripheral downward-facing surface 207, 307 surrounding the through-hole 216, 316.

In certain alternative embodiments, the set of concentric holes may include the through-hole and only the second blind hole.

The following dimensions are exemplary and not necessarily limiting. Further, the skilled artisan would understand that nominal dimensions may be slightly different in practice due to standard tolerances in the industry. The through-hole 216, 316 is optionally the diameter of a nickel, i.e., 22 mm, although that measurement is merely exemplary and the through-hole may be smaller or larger. Optionally, the through-hole is 15 mm to 30 mm, optionally 18 mm to 26 mm, optionally 20 mm to 24 mm, optionally 21 mm to 24 mm, or optionally 22 mm to 24 mm in diameter. The term "diameter" primarily applies to round, i.e., circular shaped holes. In a case where non-round concentric holes are used, the term "diameter" would refer to the shortest width dimension across the hole. For example, if the holes are rectangular, "diameter" would refer to the short-side dimension. If the holes are elliptical, "diameter" would refer to the shortest distance between the sides of the ellipse that intersects the midpoint of the ellipse.

The first blind hole 218, 318 is a larger hole of the set of concentric holes provided about the smaller through-hole 216, 316. The first blind hole 218, 318 penetrates a portion of the depth of the lasted upper 202, 302. For example, the first blind hole 218, 318 may penetrate a portion of or the entirety of the thickness of the lasted board 214, 314 of the footwear subassembly 200, 300. The first blind-hole 218, 318 is preferably about 42 mm to 44 mm in diameter, optionally 32 mm to 52 mm, optionally 36 to 48 mm, or optionally 38 to 46 mm in diameter. These measurements are merely exemplary and could vary. However, in any case, the first blind hole 218, 318 will always be larger than the through-hole 216, 316.

The second blind hole 220, 320 is of equal or preferably greater diameter to the first blind hole 218, 318 and may be provided in the midsole 206, 306 and optionally in the midsole filler 204, 304 that is sandwiched between the midsole 206, 306 and the lasted board 214, 314 of the lasted upper 202, 302. For example, in an optional embodiment, the first blind hole is 44 mm in diameter and the second blind hole is 46 mm in diameter. In an alternative embodiment the first blind hole is 42 mm in diameter and the second blind hole is 44 mm in diameter. Preferably, the difference in diameter between the first blind hole and second blind hole is minimal, optionally 0.5 mm to 5 mm, optionally 1 mm to 4 mm, optionally 1 mm to 3 mm, or optionally about 2 mm. The skilled person would recognize that each of the various holes may be sized somewhat differently while still achieving the desired functionality.

Preferably, the holes increase in size by layer from the upper towards the outsole. Optionally, in some cases, a hole in a layer closer to the outsole may be the same size as another hole in a layer that precedes it.

Methods for Filling Holes in Unfinished Footwear

The process for filling the holes and assembling the footwear may be done substantially manually, however it is preferably done in part using a hole filling apparatus 100, such as that described above with reference to FIG. 3.

Figure 10:
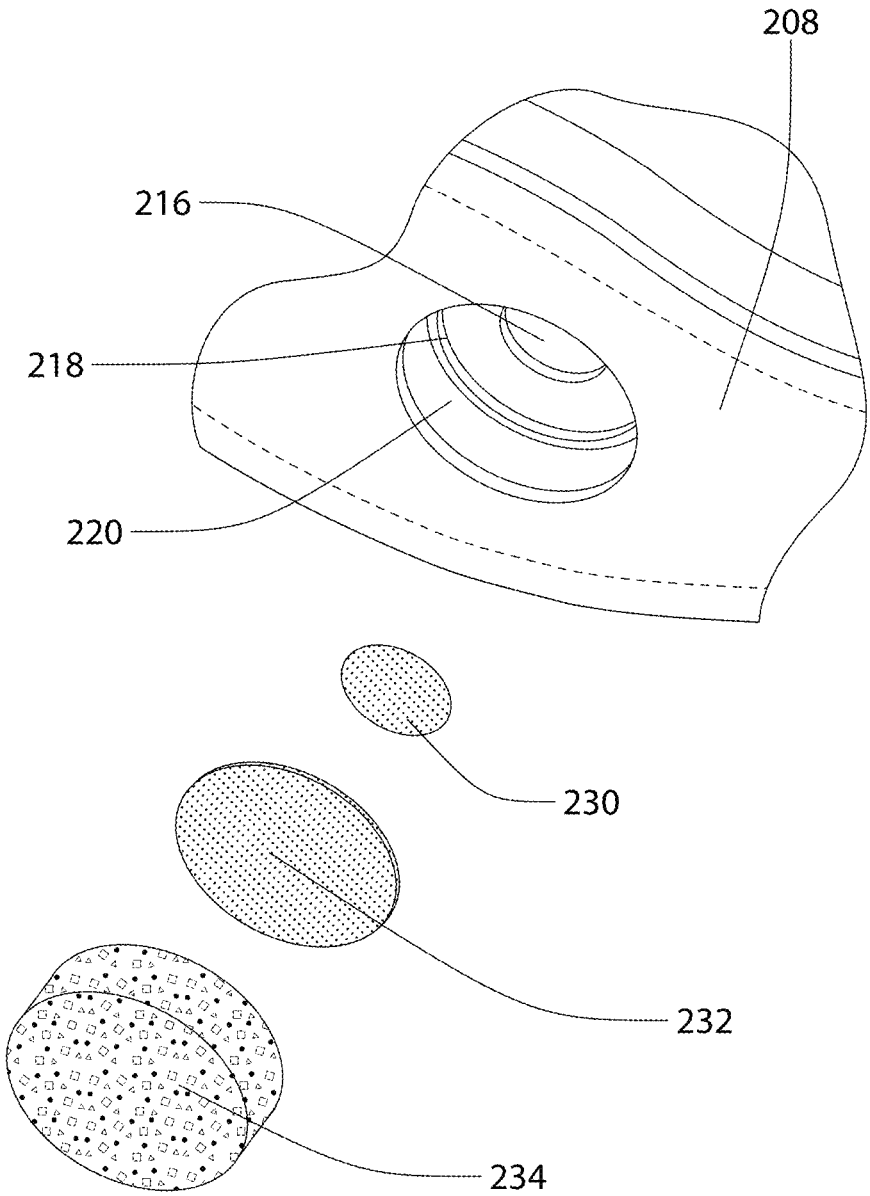
FIG. 10 is an enlarged partial exploded view of the underside of the subassembly of the Goodyear welt footwear of FIGS. 4-6 illustrating how an insole filling plug, a gasket filler and a midsole filler piece may be positioned within certain holes of the subassembly.

Referring now to FIG. 10, there is shown an enlarged partial exploded view of the underside of the subassembly of the Goodyear welt footwear 200 of FIGS. 4-6. An insole filling plug 230 is placed within the insole 210 and waterproof gasket 212 to plug the through-hole 216. The insole filling plug 230 would preferably include the same material at the same thicknesses as the insole 210 and waterproof gasket 212. This would preferably be true of any embodiment—the insole filling plug would be of the same material(s) and total thickness as the layer(s) through which the through-hole is made. For example, if a non-waterproof piece of footwear is being finished (e.g., the embodiment of FIGS. 7-9), the waterproof gasket would be omitted from the insole filling plug and the insole filling plug would composed of the same material and have the same thickness as the insole it is filling. Optionally, the insole filling plug 230 is made from synthetic fabrics or extruded/laminated paper mixtures. Optionally, the insole filling plug 230 also has a thickness that renders its bottom surface substantially flush with the upper surface of the first blind hole once the insole filling plug has been inserted.

A gasket filler 232 is placed over the insole filling plug 230 and is scaled thereto, preferably using a combination of pressure and heat, as described in more detail below. The gasket filler 232 is preferably made from fabric. Optionally, the gasket filler 232 may be made from the same material as the waterproof gasket 212. That is, it may comprise a composite of a fabric layer (wicking or non-wicking) and a waterproof membrane layer (e.g., made with one or more of cPTFE, PU, TPU or PET) along with hot melt. In embodiments having a first blind hole 218, the gasket filler 232 is positioned therein. In embodiments that do not have a first blind hole, the gasket filler may be positioned in the second blind hole. Once the gasket filler 232 is in place, a midsole filler piece 234 is then installed within the second blind hole 220 and optionally within a portion of the first blind hole 218. The midsole filler piece 234 is preferably the thickest of the layers and may optionally be made from a polymer or elastomeric material, optionally ethylene vinyl acetate (EVA). The midsole filler piece 234 is sized and shaped to snugly fit within a portion of the depth of the first blind hole 218 and the entirety of the second blind hole 220 and is preferably substantially flush with the bottom surface 208 of the midsole 206 once inserted. Where the second blind hole is slightly larger in diameter than the first blind hole, the midsole filler piece may fit snugly within the first blind hole and have a small gap between the outer periphery of the midsole filler piece and the inner diameter of the second blind hole. Notably, in any embodiment, the different hole filling layers are applied in the order of from topmost to bottommost (i.e., from the inside out) and are done from the underside of the footwear.

The process for filling the holes and assembling the footwear may be done substantially manually, however it is preferably carried out in part using a hole filling machine or apparatus, such as that described above with reference to FIG. 3. An optional method in which the hole filing apparatus 100 of FIG. 3 is used to assist in a hole filling method is illustrated in FIGS. 11-22. The method is described with reference to the subassembly of unfinished Goodyear welt footwear 200, however it should be understood that the method may be employed, at least in substantial part, with hole-filling of other embodiments of the subassembly.

Figure 11:
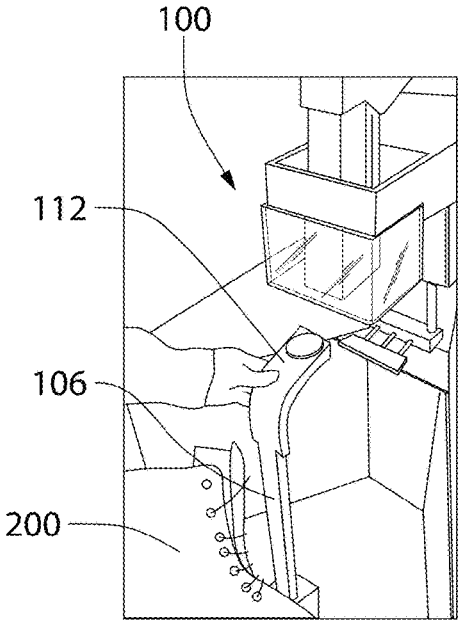
FIG. 11 is an illustration of an operator priming the product placement lever of the hole filling machine of FIG. 3, before performing a hole filling operation on the subassembly of Goodyear welt footwear shown in FIGS. 4-6.
Figure 12:
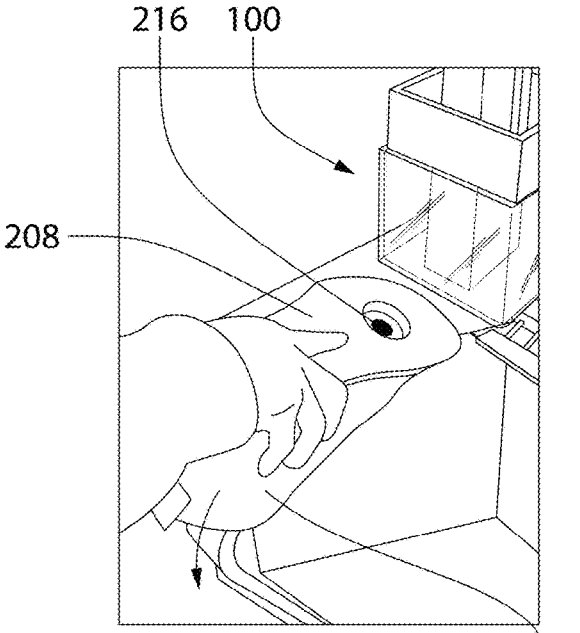
FIG. 12 is an illustration of the operator placing the subassembly of the Goodyear welt footwear of FIG. 11 onto the product placement slate of the product placement lever.
Figure 13:
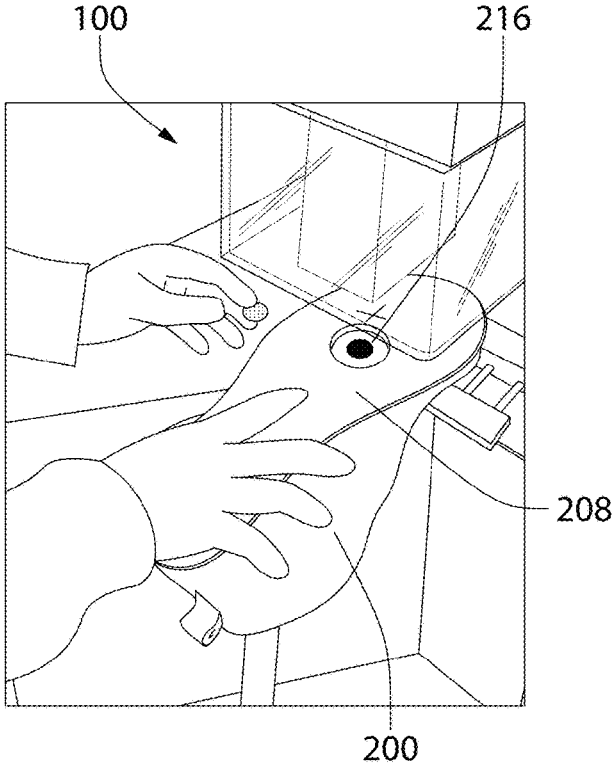
FIG. 13 is an illustration of the subassembly of the Goodyear welt footwear of FIG. 11 being retained on the product placement slate and being moved into position for the hole filling operation.

As shown in FIG. 11, the operator primes the product placement lever 104 of the apparatus 100 by moving it away from the frame 102 and towards him, thereby putting the product placement lever 104 in the product loading position L. This renders the product placement slate 112 accessible for placing the subassembly of unfinished Goodyear welt footwear 200 onto the product placement slate 112. FIG. 12 shows the operator placing the foot receiving cavity of the lasted upper 202 of the subassembly of unfinished Goodyear welt footwear 200 onto the product placement slate 112 with the bottom surface 208 facing generally up. FIG. 13 shows the subassembly of unfinished Goodyear welt footwear 200 seated securely in a resting position on the product placement slate 112, while the product placement lever 104 is being pushed forward (e.g., pivoted) towards the frame 102, approaching the hole sealing position S. When the subassembly of footwear 200 is seated in this manner, the through-hole 216 is preferably located directly on top of (and in contact with) the padded portion 114 on the product placement slate 112. The cushioning provided by the padded portion 114 helps facilitate the placement and sealing of the insole filling plug 230 and gasket filler 232.

Figure 14:
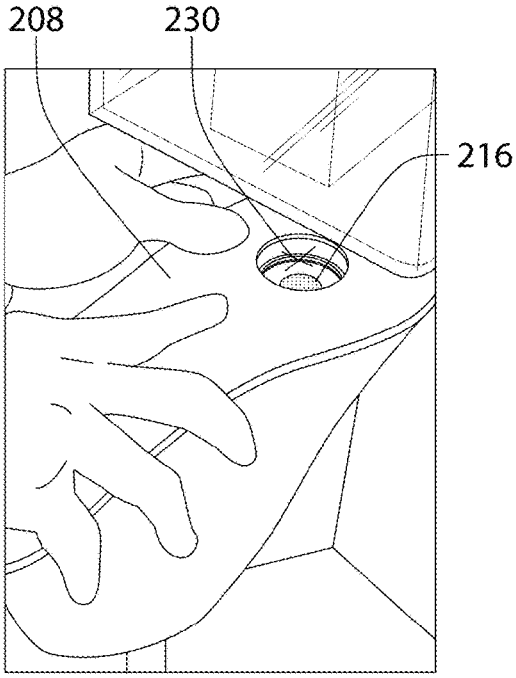
FIG. 14 is an illustration of the operator inserting an insole filling plug into a through-hole in the lasted upper of the subassembly of Goodyear welt footwear of FIG. 11.
Figure 15:
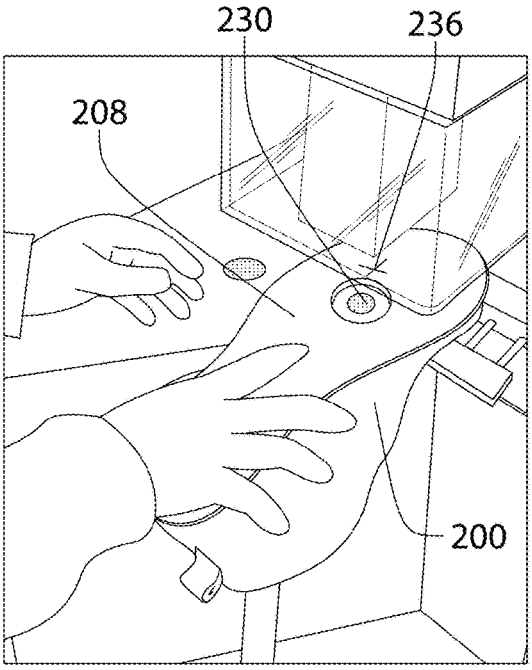
FIG. 15 is an illustration of the subassembly of the Goodyear welt footwear of FIG. 11 after the insole filling plug has been inserted into the through-hole in the lasted upper.
Figure 16:
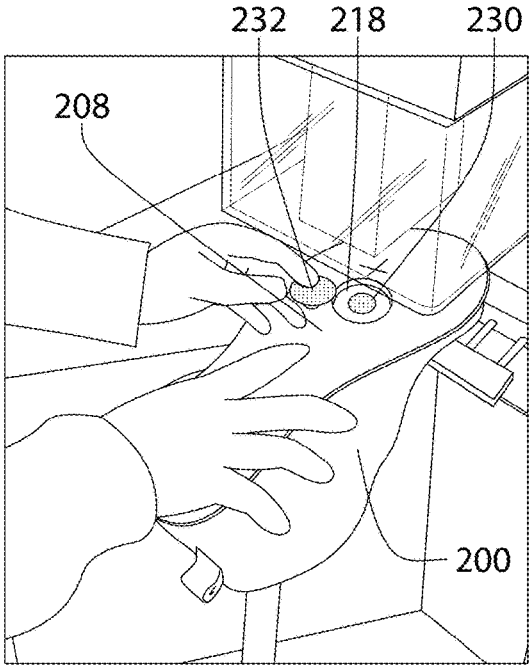
FIG. 16 is an illustration of the operator about to place a gasket filler onto the insole filling plug in the subassembly of the Goodyear welt footwear of FIG. 11.

Optionally when the product placement lever 104 is nearly, but not fully in the hole scaling position S, the operator places the insole filling plug 230 into the through-hole 216, as illustrated in FIG. 14. FIG. 15 shows the insole filling plug 230 after it has been fully and snugly placed within the through-hole 216. Referring now to FIG. 16, the operator places the gasket filler 232 over and in contact with the insole filling plug 230 and the peripheral downward-facing surface 207 of the base 203. The operator preferably centers the gasket filler 232 within the first blind hole 218 and/or the second blind hole 220.

Figure 17:
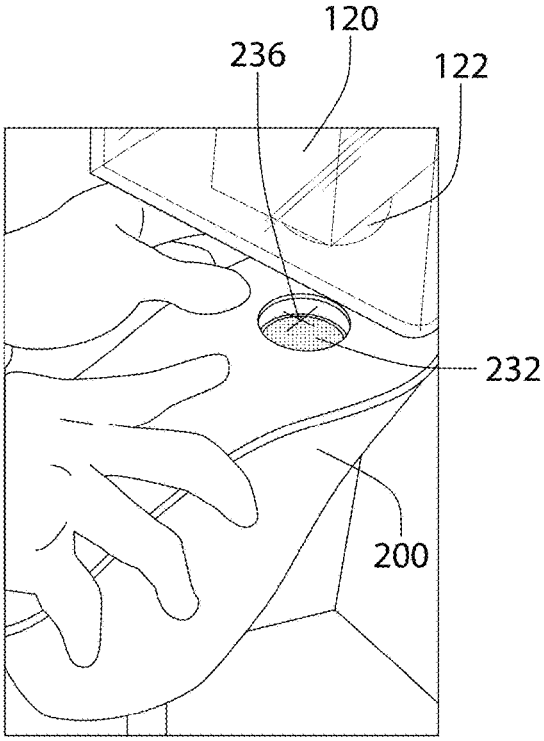
FIG. 17 is an illustration of the subassembly of the Goodyear welt footwear of FIG. 11 with the gasket filler covering the insole filling plug in the through-hole, wherein the operator is centering the gasket filler beneath laser crosshairs projected from the press of the hole filling machine.
Figure 18:
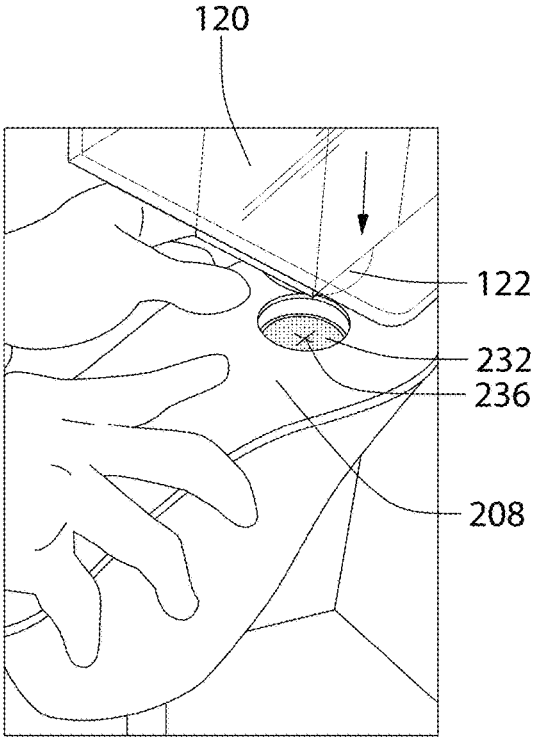
FIG. 18 is an illustration of the press descending towards the subassembly of the Goodyear welt footwear of FIG. 11.
Figure 19:
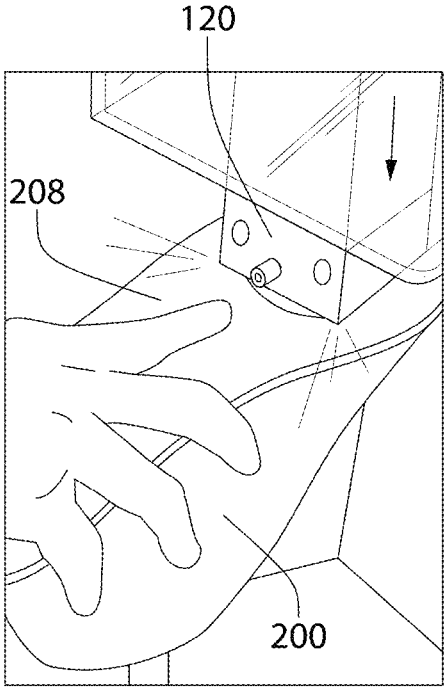
FIG. 19 is an illustration of the press applying heat and pressure against the gasket filler within the hole of the subassembly of the Goodyear welt footwear of FIG. 11 in order to permanently adhere and seal the insole filling plug and gasket filler to the lasted upper, thereby sealing the hole.

In FIGS. 17-19, the product placement lever 104 is in the hole sealing position S, wherein the vertically movable cylinder 120 and heat press 122 are located directly above the now-partially filled set of concentric holes 201. The heat press 122 preferably has a diameter slightly less than that of the first blind hole 218. For example, if the first blind hole 218 has a diameter of 44 mm, the heat press 122 may have a diameter of 42 mm. The operator optionally centers the gasket filler 232 directly beneath crosshairs 236 of light (e.g., laser) projected by the hole filling machine 100. The crosshairs 236 help the operator properly position the insole filling plug 230 and gasket filler 232 in advance of a pressing operation performed by the hole filling machine 100. FIG. 18 shows the heat press 122 moving downward towards the gasket filler 232 and FIG. 19 shows the heat press 122 inserted within the second blind hole 220 and optionally the first blind hole 216. In this position, the heat press 122 applies heat and pressure onto the gasket filler 232, the peripheral downward-facing surface 207 of the base 203 and the insole filling plug 230, which are sandwiched between the heat press 122 and the padded portion 114 on the product placement slate 112 (or the product placement slate 112 itself, if the padded portion is optionally omitted).

The heat pressing column is optionally 40-44 mm, optionally about 42 mm in diameter and fits relatively closely/snugly through the first blind hole 218 and second blind hole 220. The heat and pressure are preferably applied for a predetermined amount of time. Optionally, for waterproof footwear, the heat and pressure is applied for 10-20 seconds, optionally 12-18 seconds, or optionally about 15 seconds. Optionally, for non-waterproof footwear, the heat and pressure is applied for 4-12 seconds, optionally 5 to 10 seconds, or optionally about 8 seconds. The heat applied is optionally 130-190° C., optionally 150-185° C. or optionally 170-180° C. Optionally, in addition to heat and pressure, glue may be used to further strengthen the bond between hole filling layers. Also, while the preferred form of heat is conductive heat applied, e.g., through the heat press 122 (with heat and pressure applied simultaneously), other forms of thermal energy may be utilized as well. For example, convection through passing the footwear subassembly through an oven or radiative heat transfer, e.g., by heat activation through infrared instant irradiation are also contemplated. Glue alone without heat and pressure would not achieve the desired robust repair and construction.

Figure 20:
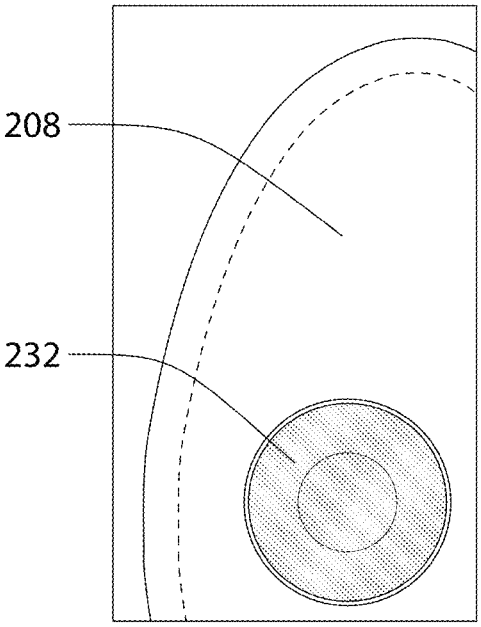
FIG. 20 is an enlarged bottom plan view of the midsole of the subassembly of the Goodyear welt footwear of FIG. 11 once the gasket filler is adhered to the lasted upper.

FIG. 20 is an enlarged partial view of the bottom surface 208 of the subassembly of unfinished Goodyear welt footwear 200 after the insole filling plug 230 and gasket filler 232 have sealed respective holes of the set of concentric holes 201.

Figure 21:
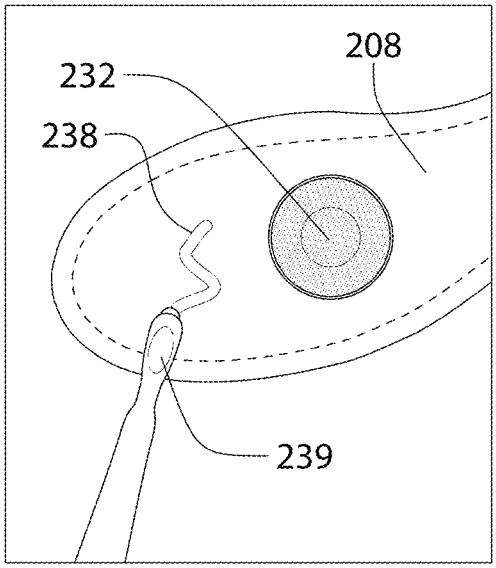
FIG. 21 is an illustration of the step of applying glue to the underside of the midsole, including within the blind hole over the gasket filler, in preparation for inserting and attaching a midsole filler piece within the blind hole and for adhering the midsole to an outsole.
Figure 22:
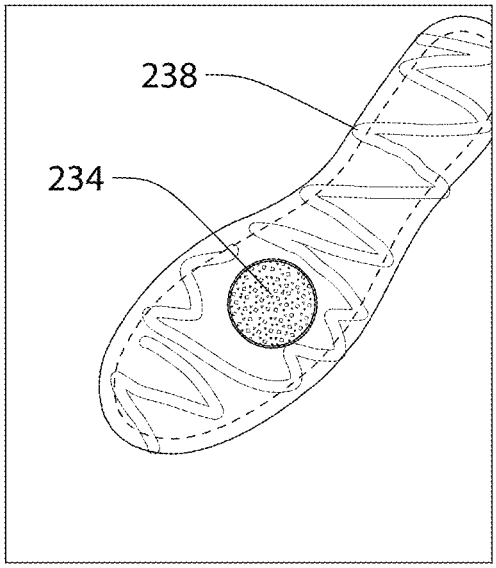
FIG. 22 is an illustration of the underside of the midsole after the midsole filler piece has been inserted and glued into the blind hole.

Once the insole filling plug 230 and gasket filler 232 are in place and sealed to the subassembly of unfinished Goodyear welt footwear 200, as shown in FIG. 21, the operator (or another person involved in assembly), optionally using an applicator 239, applies liquid adhesive 238 (e.g., glue) onto the bottom surface 208, onto the gasket filler 232 and generally within the first blind hole 218 and second blind hole 220. The operator may then install the midsole filler piece 234 within the second blind hole 220 and optionally within a portion of the first blind hole 218. The midsole filler piece 234 will then adhere to the gasket filler 232 upon drying/solidifying of the liquid adhesive therebetween. Before the liquid adhesive on the bottom surface 208 dries, the operator may apply an outsole (not shown) thereto, thereby completing the piece of footwear into a finished product.

Footwear Subassembly Embodiments after Hole-Filling

Figure 23:
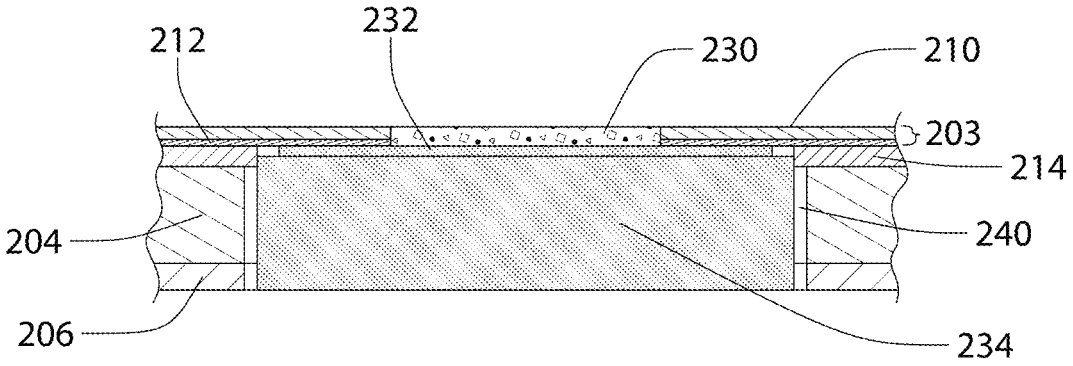
FIG. 23 is from the enlarged section view of FIG. 6 showing the respective holes filled with the insole filling plug, the gasket filler and the midsole filler piece after undergoing the method illustrated in FIGS. 11-22.
Figure 24:
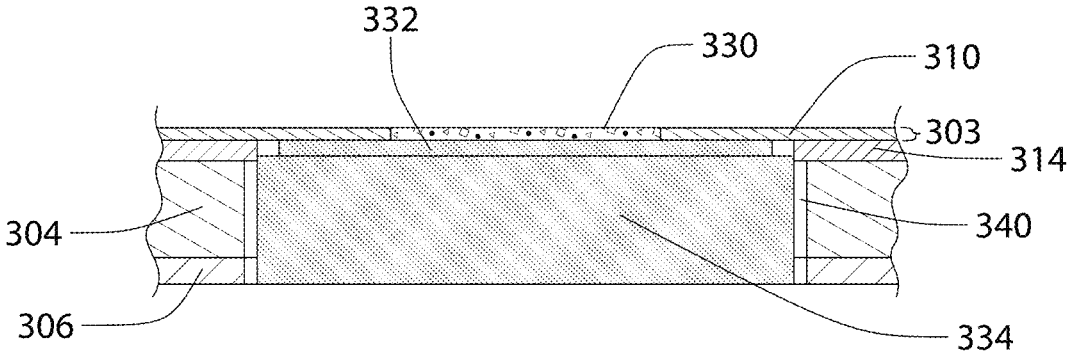
FIG. 24 is from the enlarged section view of FIG. 9 showing the holes filled with the insole filling plug, the gasket filler and the midsole filler piece after undergoing the method illustrated in FIGS. 11-22.

The final subassembly, after carrying out the steps set forth above with reference to FIGS. 11-22, and prior to the step of attaching the outsole, is shown in FIG. 23. The view and embodiment of FIG. 23 is the same as that of FIG. 6, but with the holes filled in. A similar view is shown of a non-waterproof embodiment in FIG. 24. The view and embodiment of FIG. 24 is the same as that of FIG. 9, but with the holes covered and filled in. These embodiments, which show the finished product of the methods disclosed above (minus the outsole), are described here together, with any differences highlighted. Structure already described above with respect to FIGS. 6 and 9 may not be fully repeated here for the sake of brevity.

As shown in FIGS. 23 and/or 24, the set of concentric holes 201, 301 are covered, substantially filled and sealed using the different layers of filling components. Specifically, the insole filling plug 230, 330 fits snugly within the through-hole 216, 316 to completely fill and close up the through-hole 216, 316. The bottom peripheral edge of the insole filling plug 230, 330 is completely covered and sealed by the gasket filler 232, 332, which has a greater diameter than the insole filling plug 230, 330. In this way, the gasket filler 232, 332 preferably completely covers the insole filling plug 230, 330 and a heat seal is preferably formed between those layers. In the waterproof version, this configuration ensures integrity of the waterproof seal.

The gasket filler 232, 332 optionally occupies a portion of the depth of the first blind hole 218, 318, e.g., within the layer of the lasted board 214, 314. The midsole filler piece 234, 334 occupies preferably the entire depth of the second blind hole 220, 320 and optionally extends into a portion of the depth of the first blind hole 218, 318. The diameter of the second blind hole 220, 320 is preferably slightly greater than the diameter of the midsole filler piece 234, 334, preferably leaving a slight annular gap 240, 340 between the outer radial surface of the midsole filler piece 234, 334 and the inner radial surface of the second blind hole 220, 320. This feature is provided based on the recognition that an operator carrying out the hole-filling methods would not achieve 100% alignment of all holes in every layer without minor deviations. The comparatively larger diameter of the second blind hole 220, 320 helps ensure that the midsole filler piece 234, 334 can be correctly inserted into the appropriate and effective location within the second blind hole 220, 320 (and optionally within a portion of the depth of the first blind hole 218, 318. This configuration ensures that when there is any deviation from perfect alignment of the concentric holes and the components filling the holes (which is basically inevitable), the manufacturing process and the final product will not be adversely affected.

The bottom surface of the midsole filler piece 234, 334 is preferably flush with, or at least substantially flush with (i.e., no more than 1 mm or 0.5 mm above or below) the bottom surface 208, 308 of the midsole 206, 306. Preferably, in any embodiment, the various layers filling in the holes have no vertical gaps between adjacent layers. That is, the gasket filler 232, 332 and the insole filling plug 230, 330 contact each other (with the possible exception of an adhesive layer in between), without a vertical gap in between. Likewise, the midsole filler piece 234, 334 and gasket filler 232, 332 contact each other (with the preferred exception of an adhesive layer in between), without a vertical gap in between. This would help ensure proper interaction between the various layers and robust construction for wear.

Figure 25:
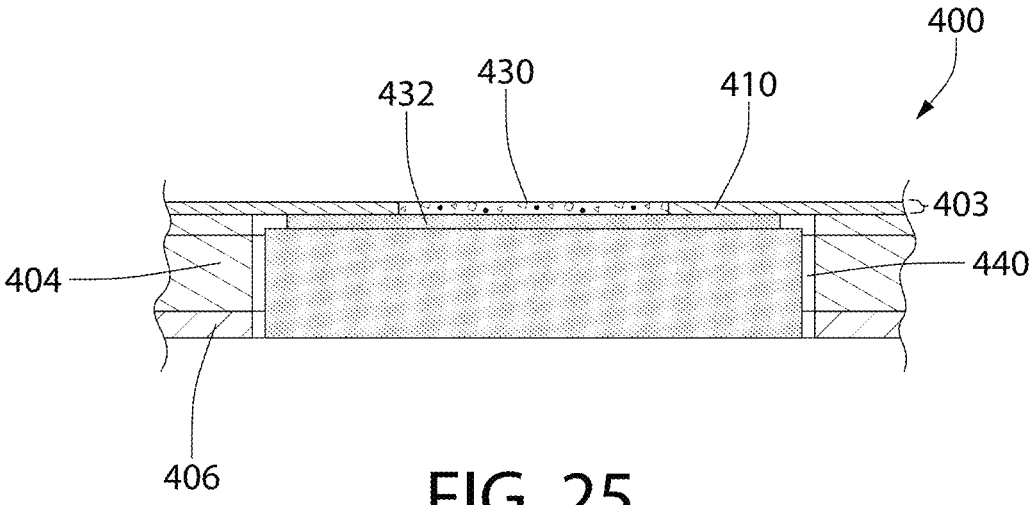
FIG. 25 is an enlarged section view (similar to the views of FIGS. 23 and 24) of another alternative version of a subassembly of Goodyear welt footwear according to an optional aspect of the disclosed concept, showing the holes filled with the insole filling plug, the gasket filler and the midsole filler piece after undergoing optional aspects of the method illustrated in FIGS. 11-22.

An alternative embodiment of a product of a variation the above-described methods is shown in FIG. 25. As shown, the subassembly of partially finished Goodyear welt footwear 400 is a non-waterproof subassembly, since it does not include a waterproof gasket. The subassembly 400 includes an insole 410 that is a component of the lasted upper. The insole 410 is preferably made from lasted board. The insole 410 is attached to the midsole filler 404, which is attached to the midsole 406. Notably, the lasted board layer through which the first blind hole was provided in the other embodiments is absent. In this embodiment, therefore, the through-hole is provided through the insole 410 and the second blind hole is provided through the midsole filler 404 and midsole 406. There is no first blind hole in this embodiment since there is no lasted board layer. In other respects, however, the presently described subassembly of footwear 400 is similar to the subassembly 300 of FIGS. 7-9 and 24. The primary difference is that in the absence of a first blind hole, the gasket filler 432, which covers and seals the insole filling plug 430, resides in an upper portion of the second blind hole within the midsole filler 404. The midsole filler piece 434 resides entirely within the second blind hole (there being no first blind hole in this embodiment) and covers and is preferably adhered to the gasket filler 432.

Exemplary Embodiments

The following exemplary embodiments further describe optional aspects of the presently disclosed technology and are part of this Detailed Description. These exemplary embodiments are set forth in a format substantially akin to claims (each with numerical designations followed by a capital letter), although they are not technically claims of the present application. The following exemplary embodiments refer to each other in dependent relationships as "embodiments" instead of "claims."

1A A method of assembling footwear, comprising:

a. providing a shoe upper with a through-hole cut into a sole of the upper;

b. attaching a lasted strobel board to an underside of the sole of the upper, the lasted strobel board having a hole through it which is larger in diameter than the through-hole and which is concentrically aligned with the through-hole once the lasted strobel board is attached to the upper, the hole through the lasted strobel board forming a first blind hole;

c. attaching a midsole filler to the lasted strobel board and attaching a midsole to the midsole filler, each of the midsole filler and midsole comprising a hole therethrough having the same diameter or greater diameter than the first blind hole and which align with the first blind hole, the holes of the midsole filler and midsole together forming the second blind hole;

d. inserting an insole filling plug into the through-hole;

e. laying a gasket filler over the insole filling plug;

f. applying heat and pressure onto the gasket filler to heat seal the insole filling plug and gasket filler to the footwear, thereby sealing the through-hole;

g. optionally applying adhesive to the underside of the midsole and within the first blind hole and second blind hole;

h. placing and retaining a midsole filler piece within the first blind hole and second blind hole; and i. optionally securing the assembled upper and midsole to an outsole, thus completing the method of assembling the footwear.

1B. A method of assembling Goodyear welt footwear, comprising:

a. providing a subassembly of unfinished Goodyear welt footwear, the subassembly comprising:

i. a lasted upper comprising a base and a foot-receiving cavity extending upward from the base;

ii. a midsole filler located beneath the base; and iii. a midsole located beneath the midsole filler;

wherein the lasted upper, midsole filler and midsole together form a layered composite, the layered composite having formed therein a set of concentric holes through the midsole, the midsole filler and the lasted upper, the set of concentric holes including a through-hole that penetrates completely through the base and a second blind hole provided through the midsole and at least a portion of a the midsole filler, the second blind hole being of a wider diameter than the through-hole, the base comprising an underside having a peripheral downward-facing surface surrounding the through-hole;

b. inserting an insole filling plug into the through-hole so as to completely fill the through-hole;

c. laying a gasket filler over and in contact with the insole filling plug so as to completely cover the insole filling plug, the gasket filler having a periphery that contacts the peripheral downward-facing surface surrounding the through-hole;

d. applying heat and pressure onto the gasket filler to heat seal the insole filling plug and gasket filler to the base, thereby sealing the through-hole and coupling the insole filling plug and gasket filler to the base;

e. optionally applying adhesive to an underside of the midsole and within the second blind hole;

f. placing and retaining a midsole filler piece within the second blind hole; and g. optionally adhering the midsole to an outsole, thereby assembling the Goodyear welt footwear.

2B. A goodyear welt boot made according to the method of embodiment 1B.

1C. A method of assembling Goodyear welt footwear, comprising:

a. providing a subassembly of unfinished Goodyear welt footwear, the subassembly comprising:

i. a lasted upper comprising a base and a foot-receiving cavity extending upward from the base;

ii. a midsole filler located beneath the base; and iii. a midsole located beneath the midsole filler;

wherein the lasted upper, midsole filler and midsole together form a layered composite, the layered composite having formed therein a set of concentric holes through the midsole, the midsole filler and the lasted upper, the set of concentric holes including a through-hole that penetrates completely through the base and a second blind hole provided through the midsole and at least a portion of a the midsole filler, the second blind hole being of a wider diameter than the through-hole, the base comprising an underside having a peripheral downward-facing surface surrounding the through-hole;

b. inserting an insole filling plug into the through-hole so as to completely fill the through-hole;

c. laying a gasket filler over and in contact with the insole filling plug so as to completely cover the insole filling plug, the gasket filler having a periphery that contacts the peripheral downward-facing surface surrounding the through-hole;

d. applying heat and pressure onto the gasket filler to heat seal the insole filling plug and gasket filler to the base, thereby sealing the through-hole and coupling the insole filling plug and gasket filler to the base; and e. placing and retaining a midsole filler piece within the second blind hole.

A skilled artisan understands that one may omit any of the above-mentioned components and/or assembly steps or add additional components and/or assembly steps and still fall within the scope of the disclosed concept.

While the presently disclosed technology has been described in detail and with reference to specific examples thereof, it will be apparent to one skilled in the art that various changes and modifications can be made therein without departing from the spirit and scope thereof. It is understood, therefore, that the presently disclosed technology is not limited to the particular embodiments disclosed, but it is intended to cover modifications within the spirit and scope of the present presently disclosed technology.

What is claimed is:

1. A method of assembling Goodyear welt footwear, comprising:

a. providing a subassembly of unfinished Goodyear welt footwear, the subassembly comprising:

i. a lasted upper comprising a base and a foot-receiving cavity extending upward from the base;

ii. a midsole filler located beneath the base; and iii. a midsole located beneath the midsole filler;

wherein the lasted upper, midsole filler and midsole together form a layered composite, the layered composite having formed therein a set of concentric holes through the midsole, the midsole filler and the lasted upper, the set of concentric holes including a through-hole that penetrates completely through the base and a second blind hole provided through the midsole and at least a portion of a the midsole filler, the second blind hole being of a wider diameter than the through-hole, the base comprising an underside having a peripheral downward-facing surface surrounding the through-hole;

b. inserting an insole filling plug into the through-hole so as to completely fill the through-hole;

c. laying a gasket filler over and in contact with the insole filling plug so as to completely cover the insole filling plug, the gasket filler having a periphery that contacts the peripheral downward-facing surface surrounding the through-hole;

d. applying heat and pressure onto the gasket filler to heat seal the insole filling plug and gasket filler to the base, thereby sealing the through-hole and coupling the insole filling plug and gasket filler to the base;

e. applying adhesive to an underside of the midsole and within the second blind hole;

f. placing and retaining a midsole filler piece within the second blind hole; and g. adhering the midsole to an outsole, thereby assembling the Goodyear welt footwear.

2. The method of claim 1, the set of concentric holes being located in a front half of the layered composite.

3. The method of claim 1, wherein the holes of the set of concentric holes are round and share a common central axis.

4. The method of claim 1, wherein the layered composite includes at least one additional layer between the lasted upper and the midsole filler and/or between the midsole filler and the midsole.

5. The method of claim 1, wherein the layered composite further includes a lasted board between the base and the midsole filler, there being formed through the lasted board a first blind hole having a wider diameter than the through-hole and smaller diameter than the second blind hole, the first blind hole being part of the set of concentric holes.

6. The method of claim 5, wherein the holes of the set of concentric holes are round and share a common central axis.

7. The method of claim 1, wherein steps (b), (c) and (d) are carried out using an apparatus, the apparatus comprising a product placement slate over which the foot receiving cavity is placed with the underside of the midsole facing generally up such that the set of concentric holes lays atop the product placement slate, at which point steps (b) and (c) are carried out, the method further comprising inserting a heat press of the apparatus into the second blind hole to perform a pressing operation against the gasket filler to complete step (d).

8. The method of claim 5, wherein steps (b), (c) and (d) are carried out using an apparatus, the apparatus comprising a product placement slate over which the foot receiving cavity is placed with the underside of the midsole facing generally up such that the set of concentric holes lays atop the product placement slate, at which point steps (b) and (c) are carried out, the method further comprising inserting a heat press of the apparatus into the second blind hole to perform a pressing operation against the gasket filler to complete step (d).

9. The method of claim 8, wherein the heat and pressure are applied by the heat press for 12-18 seconds at 150-185° C.

10. The method of claim 8, wherein the heat and pressure are applied by the heat press for 5-10 seconds at 150-185° C.

11. The method of claim 5, wherein the midsole filler is from 5-7 mm thick or from 7-9 mm thick.

12. The method of claim 5, wherein the midsole filler is made from cork, rubber or ethylene vinyl acetate (EVA) foam.

13. The method of claim 5, wherein the midsole is made from rubber, ethylene vinyl acetate (EVA) foam or polyvinyl chloride (PVC) foam.

14. The method of claim 5, the base comprising a waterproof gasket layer.

15. The method of claim 5, wherein the insole filling plug is made of the same material as the base.

16. The method of claim 5, wherein the midsole filler piece is made of the same material as the midsole filler.

17. The method of claim 1, wherein the midsole filler piece fills an entire depth of the second blind hole such that a bottom surface of the midsole filler piece is substantially flush with the underside of the midsole.

18. The method of claim 1, the diameter of the second blind hole being slightly greater than the diameter of the midsole filler piece, thereby resulting in a slight annular gap between an outer radial surface of the midsole filler piece and an inner radial surface of the second blind hole.

19. The method of claim 1, wherein there is no vertical gap between the insole filling plug and the gasket filler or between the gasket filler and the midsole filler piece.

20. The method of claim 2, wherein:

the holes of the set of concentric holes are round and share a common central axis;

the midsole filler piece fills an entire depth of the second blind hole such that a bottom surface of the midsole filler piece is substantially flush with the underside of the midsole;

the diameter of the second blind hole is slightly greater than the diameter of the midsole filler piece, thereby resulting in a slight annular gap between an outer radial surface of the midsole filler piece and an inner radial surface of the second blind hole; and there is no vertical gap between the insole filling plug and the gasket filler or between the gasket filler and the midsole filler piece.

21. The method of claim 20, wherein steps (b), (c) and (d) are carried out using an apparatus, the apparatus comprising a product placement slate over which the foot receiving cavity is placed with the underside of the midsole facing generally up such that the set of concentric holes lays atop the product placement slate, at which point steps (b) and (c) are carried out, the method further comprising inserting a heat press of the apparatus into the second blind hole to perform a pressing operation against the gasket filler to complete step (d).

22. The method of claim 21, wherein the heat and pressure are applied by the heat press for 5-18 seconds at 150-185° C.

* * * * *